United States Patent [19]

Sugimura et al.

[11] Patent Number: 4,883,733

[45] Date of Patent: Nov. 28, 1989

[54] ELECTROPHOTOGRAPHIC PRINTING PROCESS USING PHOTOCHROMIC COMPOUND

[75] Inventors: Hiroshi Sugimura, Habikino; Eiji Imada, Nara; Yoshimi Kojima, Nara; Shuhei Tsuchimoto, Nara, all of Japan

[73] Assignee: Sharp Kabushiki Kaisha, Osaka, Japan

[21] Appl. No.: 219,932

[22] Filed: Jul. 15, 1988

[30] Foreign Application Priority Data

Jul. 17, 1987 [JP] Japan ..... 62-179715

[51] Int. Cl.[4] ..... G03G 13/22

[52] U.S. Cl. ..... 430/54; 430/58; 430/59; 430/75; 430/19; 430/902; 430/952

[58] Field of Search ..... 430/54, 55, 346, 19, 430/58

[56] References Cited

U.S. PATENT DOCUMENTS 3,837,853 9/1974 Masaki ..... 430/55

*Primary Examiner*—J. David Welsh

*Attorney, Agent, or Firm*—Spencer & Frank

[57] ABSTRACT

An electrophotographic printing process is disclosed that comprises the steps of: imagewise exposing a photosensitive means with light of a wavelength at which photochromism occurs, to thereby record the image therein, wherein said photosensitive means has a photosensitive layer formed on a conductive support, said photosensitive layer containing a photochromically sensitive compound that shows photoconductivity when irradiated with light of different wavelengths before and after said photochromism occurs; charging the entire surface of said photosensitive layer; and uniformly exposing said photosensitive means with light of a wavelength at which photochromism does not occur, but at which said photochromically sensitive compound or photoisomeric compound therewith shows photoconductivity, to thereby form the image of a charge pattern on the surface of said photosensitive layer.

13 Claims, 2 Drawing Sheets

3
2
1
A
(DARK)
λ1

A
B

A
B
+++ ++++
λ4

A
B
++++

A
B
++++
λ2

A
CLEANING
DEVELOPING

ELECTROPHOTOGRAPHIC PRINTING PROCESS USING PHOTOCHROMIC COMPOUND

BACKGROUND OF THE INVENTION 1. Field of the Invention

This invention relates to an electrophotographic printing process, and more particularly, it relates to a novel printing process based on electrophotography. 2. Description of the Prior Art Fromthe viewpoint of facility in procedures, electrophotographic copying processes for many copies have been contrived, in addition to printing processes, as processes for the duplication of manuscripts in many copies. As a representative electrophotographic copying process for many copies, there is, for example, the electrostatic copying process, in which the image is exposed on a photosensitive layer that is photoconductive and has optical memory effects, and then the steps of charging, developing, transferring, and cleaning are repeated. This process is based on the principle that the exposed portion of the photosensitive layer turns electroconductive by its optical memory effects, thereby making it difficult to electrify that portion. As a photosensitive means using optical memory effects, known organic photosensitive means for an electrophotographic copying process can comprise poly-N-vinylcarbazole (PVK) and 2,4,7-trinitrofluorenone (TNF), wherein the organic photosensitive means contain, as the third ingredient, a leuco dye (E. Inoue, I. Shimizu, and Y. Nishino, Photogr. Sci. Eng., 22, 194 (1978), or a diazonium salt (J. Hanna and E., Inoue, ibid., 25, 209 (1981)).

In recent years, there was disclosed a photosensitive means for an electrophotographic copying process that comprises a photoconductive layer containing a hydrazone compound and a halogen-substituted anthracene derivative (Japanese Laid-Open Patent Application No. 60-164748).

Other processes include a copying process in which a switching element layer the electroconductivity of which varies in an electric field of high strength, is provided between a photosensitive layer and a photoconductive support. Here the image is recorded and stored in the switching element layer. For example, an electrophotographic system comprising a PVK-TNF photosensitive means and a Cu.TCNQ (7,7,8,8-tetracyanoquinodimethane) complex is known (Japanese Laid-Open Patent Applicatin No. 60-207143).

In the process comprising a photosensitive means based on the optical memory effects mentioned above, there are many problems with the known photosensitive means, such as the sensitivity of the photosensitive means being too low to give the desired optical memory effects, the capability of the photosensitive means to store the image being also too low, and the like.

On the other hand, in the second process comprising a switching element layer, the following problems occur. The photosensitive layer must be able to transfer both holes and electrons, so the materials available that can be used for the photosensitive layer are limited. The memory effects of a switching element layer depend greatly on the thickness of the layer, the dispersion ratio of the materials used for the layer, and the kind of binders contained in the layer, requiring the switching element layer to be prepared with great accuracy.

Also, as a problem common to the two processes mentioned above, a step of heating is needed to remove the image, thereby bringing about a complication in the structure of the apparatus for these processes.

SUMMARY OF THE INVENTION

The electrophotographic printing process of this invention, which overcomes the above-discussed and numerous other disadvantages and deficiencies of the prior art, comprises the steps of: imagewise exposing a photosensitive means with light of the wavelength, at which photochromism occurs, to thereby record the image therein. The photosensitive means has a photosensitive layer formed on a conductive support. The photosensitive layer contains a photochromically sensitive compound that exhibits photoconductivity when irradiated with light of different wavelengths before and after the photochromism occurs; charging the entire surface of the photosensitive layer; and uniformly exposing the photosensitive means with light of a wavelength, at which photochromism does not occur, but the photochromically sensitive compound or a photoisomeric compound there included exhibits photoconductivity, to thereby form the image of a charge pattern on the surface of the photosensitive layer.

In a preferred embodiment, the electrophotographic printing process further comprises the step of exposing the photosensitive means with light of a wavelength, at which the photoisomeric compound is converted into said photochromically sensitive compounds, to thereby remove the image therefrom.

In a preferred embodiment, the photosensitive layer is composed of a charge-generation layer containing the photochromically sensitive compound and a charge-transfer layer containing charge-transfer substances.

Thus, the invention described herein makes possible the objectives of: (1) providing an electrophotographic printing process in which a photosensitive layer is used that comprises as active ingredients chemical compounds having photochromic sensitivity and photoconductivity; (2) providing an electrophotographic printing process in which printed matter can be readily made at low cost compared to the conventioal printing processes because a plurality of copies can be made by one exposure of the image; (3) providing an electrophotographic printing process in which the photosensitive means that is used is readily prepared, and the step of copying is simple; (4) providing an electrophotographic printing process in which there is no need of heat treatment for removal of the image, and all procedures therefor are carried out optically; and (5) providing an electrophotographic printing process that is also useful as a novel method for reading of recorded information on photochromic sensitive media.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
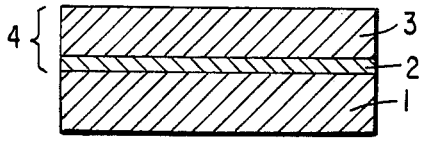
FIGS. 1 to 4 are schematic sectional views of various photosensitive means that can be used in the electrophotographic printing process of this invention.
Figure 3:
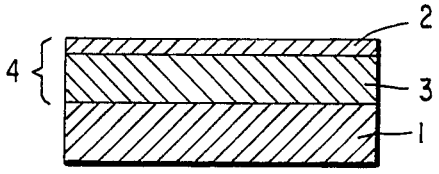

The electrophotographic printing process of this invention utilizes an electrophotographic photosensitive means comprising a photosensitive layer formed on a conductive support, the photosensitive layer containing as an active igredient a chemical compound that has photochromic sensitivity and photoconductivity. In this printing process, the two steps are carried out by the use of light with specific wavelengths and intensities. First, the step of image exposure which uses a variation of the spectroscopic characteristics of the phtosensitive means based on the photoisomerization of the above-mentioned chemical compound. Second, the step of forming the image of a charge pattern on the photosensitive means based on the photoconductivity of the above-mentioned chemical compound. Thus, a plurality of copies can be made by one exposure of the image.

The conductive support used in the electrophotographic printing process of this invention can be any of such supports well known in the art. The conductive support, can be an insulating substrate on which a conductive layer is deposited. For example, these can be used: a metal drum or sheet of aluminium, copper, or the like, or a laminated product of any of these metal foils, or a vapordeposited product of any of these metals.

As the photosensitive layer that is provided on the conductive support mentioned above, those layers that contain as an active ingredient a chemical compound having photochromic sensitivity and photoconductivity can be used. The term "photochromic sensitivity" as used herein refers to the property by which a chemical compound can have its structure changed reversibly by light of specific wavelengths different from each other, so that the absorption spectrum of this compound is changed (i.e., photochromism). Also, that this chemical compound is photoconductive means that with the various changes in structure mentioned above, conductivity is conferred by the absorption of light of a specific wavelength. In general, as shown in the formula below, a chemical compound A with its absorption peak at a wavelength $\lambda_3$ for photoconductivity is irradiated with light of the wavelength $\lambda_1$ to absorb the light with the said wavelength, and thereby changes to a chemical compound B with an absorption maximum at the wavelength $\lambda_4$ for photoconductivity. On the other hand, the chemical compound B changes to the chemical compound A when irradiated with light of the wavelength $\lambda Z_2$.

$$A \xrightarrow{\lambda_1} B$$

-continued $$(\lambda_3) \xleftarrow[\lambda_2]{} (\lambda_4)$$

There are chemical compounds in which the absorption wavelength at which photoconductivity is shown and the absorption peak at which photochromism occurs is the same. An example of compounds that are photochromically sensitive and photoconductive are, thioindigo compounds. These chemical compounds have structural isomerization from trans (Formula I, A) to cis form (B) and vice versa.

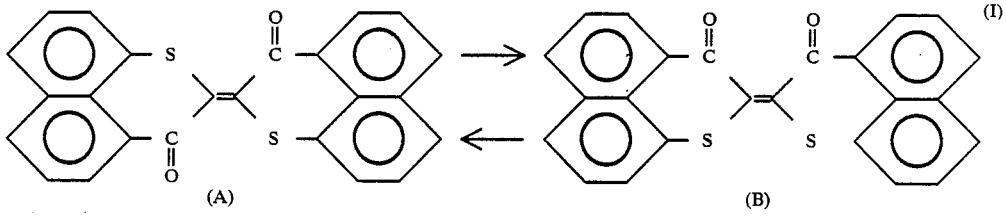

The trans form (A) has an absorption peak at the wavelength ($\lambda_3$) of 620 nm, and the cis form (B) has an absorption peak at the wavelength ($\lambda_4$) of 500 nm. The wavelength ($\lambda_1$) at which isomerization occurs from the trans form to the cis form is 620nm. The wavelength ($\lambda_2$) at which isomerization occurs from the cis form to the trans form is 510 nm. Not only the thioindigo compounds mentioned above, but also other chemical compounds that both are reversibly isomerized by light and that have photoconductivity can be used.

The photosensitive layer of this invention contains the above-mentioned photoconductive compound with photochromic sensitivity with charge-transfer substances. The photosensitive layer can be a functionally separated layer structure that is composed of a charge-generation layer and a charge-transfer layer. In this case, the photoconductive compound with photochromic sensitivity is used in the charge-generation layer. As the charge-transfer substance contained in the above-mentioned photosensitive layer or charge-transfer layer, there can be included hydrazone, pyrazolin, diarylalkane, alkylenediamine, dibenzylaniline, triphenylamine, diphenylbenzylamine, triarylalkane, oxadiazole, anthracene, oxazole, and the like. Besides these compounds, there can be used a polymer such as poly-N-vinylcarbazole. The charge-transfer substances can also be used in the form of a mixture thereof.

The electrophotographic photosensitive means that is used in the printing process of this invention can be prepared by any of the well known methods. For example, when the functionally separated photosensitive layer mentioned above is provided on a conductive support, the following method can be used. First, the photoconductive compound with photochromic sensitivity is dissolved or dispersed in an appropriate solvent together with a binder, forming a liquid for application. This liquid is applied on a conductive support and dried, resulting in a charge-generation layer. Next, the above-mentioned charge-transfer substance and a binder are likewise dissolved in an appropriate solvent to make a second liquid for application. This liquid is applied to the top of the charge-generation layer and dried, resulting in a charge-transfer layer. The thickness of the layer after being dried is preferably $10^{-1}$ $\mu$m to several micrometers for the charge-generation layer, and several micrometers to several tens of micrometers for the charage-transfer layer.

As the above-mentioned binders, there can be included polymers and copolymers of vinyl compounds including styrene, vinyl acetate, acrylic ester, and methacrylic ester, phenoxy resins, polysulphones, polyarylates, polycarbonates, polyesters, cellulose esters, cellulose ethers, urethane resins, epoxy resins, and acrylpolyol resins.

Examples of the above-mentioned solvents that can be used in preparation of the liquid for application include basic solvents such as butyl amine and ethylene diamine; ethers such as tetrahydrofuran and 1,4-dioxane; ketones such as methylethylketone and cyclohexanone; aromatic hydrocarbons such as toluene and xylene; aprotic polar solvents such as N,N-dimethylformamide, acetonitrile, and dimethylsulfoxide; alcohols such as methanol, ethanol, and propanol; esters such as ethyl acetate and methyl acetate; and chlorinated hydrocarbons such as dichloroethane and chloroform.

The charge-generation layer may also be formed by, the method of the direct vapor deposition of a photochromic sensitive compound that is also photoconductive on a conductive support.

Figure 2:
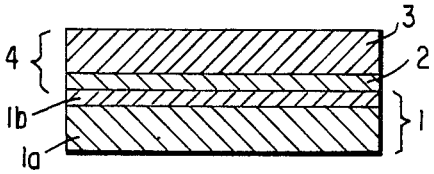
Figure 4:
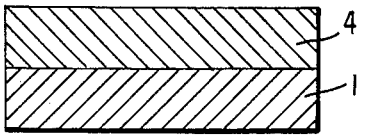

The layers that have been mentioned above, including the charge-generation layer and the charge-transfer layer, are disposed on the conductive support, by which the electrophotographic photosensitive means used in the printing process of this invention is obtained. The disposition of the layers in this photosensitive means is shown in FIGS. 1 to 4. On the conductive support 1, there is provided the charge-generation layer 2 that contains a photoconductive compound with photochromic sensitivity. Then, the charge-transfer layer 3 is disposed on the charge-generation layer 2, so that the photosensitive layer 4 is formed as shown in FIG. 1. FIG. 2 shows another photosensitive means in which the conductive support 1 has a conductive layer 1*b* that is vapor-deposited on an insulating substrate 1*a*. It is also acceptable in the order of layering of the charge-generation layer 2 and the charge-transfer layer 3 to be reversed (see FIG. 3). It is further possible to have a photosensitive layer on the conductive support 1 that has the photoconductive compund mentioned above as the charge-generation substance; the layer can also contain, if needed, charge-transfer substances (see FIG. 4). Also, although not shown in the figures, other acceptable possibilities are to have a barrier layer for charge injection between the conductive support 1 and the photosensitive layer 4 (if needed), to have an undercoating layer to improve adhesion, etc.

The electrophotographic photosensitive means above can have an image recorded thereon readily erased by the reversible isomerization of the photochromic sensitive compound. That is, when the structure for the recording of the image has been isomerized, the structure can be irradiated with light of the specific wavelength to isomerize the second structure causing the original structure to be obtained, thus erasing the image.

The operation of the electrophotographic photosensitive means with structures as described above will be hereinafter described with reference to FIG. 5.

Figures 5A, 5B, 5C, 5D, 5E, 5F:
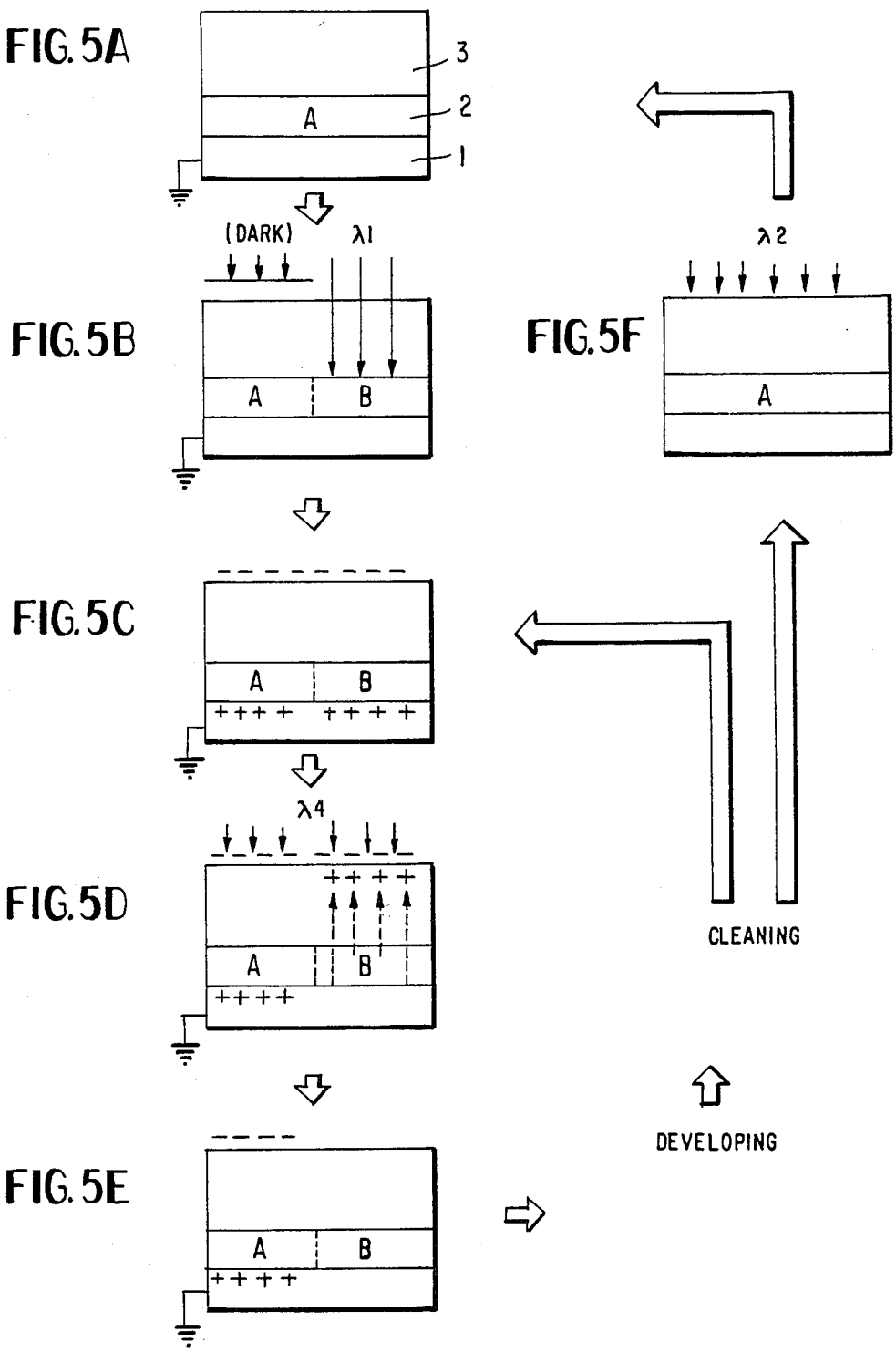
FIGS. 5 A to F is a flow diagram showing the operation of the electrophotographic printing process of this invention.

First, in the early stage shown in FIG. 5A, all of the photoconductive compound with photochromic sensitivity is the form of chemical compound A (in for this to be so, in the synthesis step of the photoconductive compound and in the preparation of samples, only compound A is made, or else a removal step (F) is carried out).

Next, light of the wavelength $\lambda_1$ is used, which causes the isomerization reaction of compound A to compound B, and exposure of the image takes place as shown in FIG. 5B. In the bright areas, compound A is isomerized to compound B, and the image is recorded.

As shown in FIG. 5C, the surface of the photosensitive means is then charged by corona charging so as to be of uniform polarity. When this surface of the photosensitive means is irradiated uniformly with light of the wavelength $\lambda_4$ at which compound B has its absorption peak maximum the charge-generation layer gives rise to carriers in the regions with compound B, and the carriers move to the surface of the photosensitive means, by which the electrical charge of the surface is removed (see FIG. 5D). In this way, as is shown in FIG. 5E, an electrostatic latent image is formed. By the use of well-known methods, this electrostatic latent image is developed with the use of toner, and the image formed of toner is transferred to paper or the like, producing an output copy. When the same copy is to be made continuously, the charging step (C) is repeated, followed by the same kinds of steps as are shown in FIG. 5. A cleaning step between repeats of these steps should be carried out in a manner to not erase the image, by the use of reduced intensity of light, short time of exposure, or the like. When the image is to be erased, light of the wavelength $\lambda_2$, which causes the isomerization reaction from compound B to compound A, is used to expose the entire surface of the photosensitive means (FIG. 5F).

When chemical compounds for which the wavelength $\lambda_2$ is equal to the wavelength $\lambda_4$ are used, a uniform exposing step (D) makes it possible to erase the image. In this case, the amount of light for exposure must be insufficient to cause photochromism.

Also, as described above, the image is recorded as B in the bright areas and A in the dark areas, but it is also possible to use a recording method with the bright areas being A and the dark areas being B.

The invention will be further illustrated by the following Example, but is not limited thereby in any manner.

Example

Two parts by weight of thioindigo compound I and one part by weight of phenoxy resin were added to 47 parts by weight of 1,4-dioxane, and the mixture was pulverized in a ball mill for about 20 hours; 50 parts by weight of 1,4-dioxane was then added thereto, resulting in a liquid for application. This liquid for application was applied to an aluminium plate with an applicator to a thickness which after drying would be about 0.2 $\mu$m, forming a charge-generation layer. Separately, one part by weight of a charge-transfer substance and one part by weight of polycarbonate resin were dissolved in eight parts by weight of dichloroethane, the charge-transfer substance being of the following formula II.

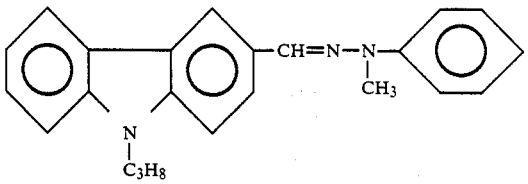

(II)

This solution was applied to the charge-generation layer with an applicator to thickness which after drying would be about 20 μm, forming a charge-transfer layer. These layers were dried at 80° C. for 1 hour, which gave an electrophotographic photosensitive means of this invention The thioindigo compounds I contained in the charge-generation layer of the electrophotographic photosensitive means obtained by the above method are mixtures of the trans and cis forms shown below.

(I)

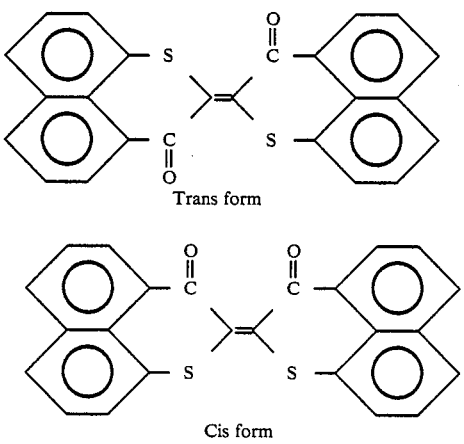

The photosensitive means obtained was exposed for about 1 minute to a 550-W halogen lamp as the light source using an infrared-absorbing filter and an interference filter so that the wavelength of the light was 510 nm and the intensity of the light was 200 $\mu W/cm^2$. At this wavelength all molecules of compound I were photoisomerized to the trans form. After exposure, the visible reflection spectrum of the photosensitive means was measured, and an absorption peak was found at 620 nm. This finding showed that the absorption peak at 508 nm arising from the cis form had disappeared, and that isomerization had taken place.

Next, in the same way, the photosensitive means was subjected to image exposure with light for about 1 minute with an interference filter so that the wavelength of the light was 620 nm and the intensity of the light was 200 $\mu W/cm^2$. This photosensitive means was attached to an aluminium drum with a diameter of 80 mm, and was installed in an experimental arrangement into a commercially available electrophotographic copying machine (SF-8200; Sharp K.K.). Light of the wavelength of 550 nm or more was used so that the light for exposure would be uniform. The cycle of charging, uniform exposure light, toner development, image transfer to ordinary paper, and cleaning was repeated continuously, and electrostatic printing was conducted in this way. After printing for 100 cycles, noise and reduced contrast of the image were almost non existent compared to the original image, and clear printed matter was obtained. In the cleaning step, a 300-W halogen lamp was used as the decharging light. Photoisomerization did not occur because of the short time of exposure, so that the image was not affected. Finally, the image was removed by the use of light with the wavelength of 510 nm, and then another manuscript was used for image exposure with light of the wavelength of 620 nm. Clear printed matter was obtained, which indicated that the photosensitive means could be used repeatedly.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An electrophotographic printing process comprising the steps of:

imagewise exposing a photosensitive means with light of a first wavelength at which photochromism occurs, to thereby record the image therein, wherein said photosensitive means has a photosensitive layer formed on a conductive support, said photosensitive layer containing a photochromically sensitive compound that shows photoconductivity when irradiated with light of different wavelengths before and after said photochromism occurs;

charging the entire surface of said photosensitive layer; and uniformly exposing said photosensitive means with light of a third or fourth wavelength at which photochromism does not occur, but at which said photochromically sensitive compound or photoisomeric compound therewith shows photoconductivity respectively, to thereby form the image of a charge pattern on the surface of said photosensitive layer.

2. An electrophotographic printing process according to claim 1 further comprising the step of :

exposing said photosensitive means with light of a second wavelength at which said photoisomeric compound is converted into said photochromically sensitive compound, to thereby remove the image therefrom.

3. An electrophotographic printing process according to claim 1, wherein said photosensitive layer is composed of a charge-generation layer containing said photochromically sensitive compound and a charge-transfer layer containing charge-transfer substances.

4. An electrophotographic printing process comprising:

(A) exposing a photosensitive means to light of a first wavelength ($\lambda_1$) such that the light corresponds to a pattern to be copied, said photosensitive means comprising a photosensitive layer having a photoisomeric, photoconductive compound which forms another isomer when exposed to light of the first wavelength, whereby the pattern is recorded in the photosensitive layer as the isomer, said compound and said isomer being conductive when exposed to light of a second ($\lambda_3$) and third ($\lambda_4$) wavelength, respectively, said photosensitive layer being disposed on a conductive support;

(B) charging the entire surface of said photosensitive means; and (C) uniformly exposing said charged photosensitive means with light of the second wavelength, to form a charge pattern corresponding to the pattern to be copied on the surface of the photosensitive means.

5. The electrophotographic printing process of claim 4, wherein said photosensitive means is exposed to light of a fourth wavelength ($\lambda_2$) which converts the isomer to the compound.

6. The electrophotographic printing process of claim 4, wherein said photoisomeric, photoconductive compound is of the formula

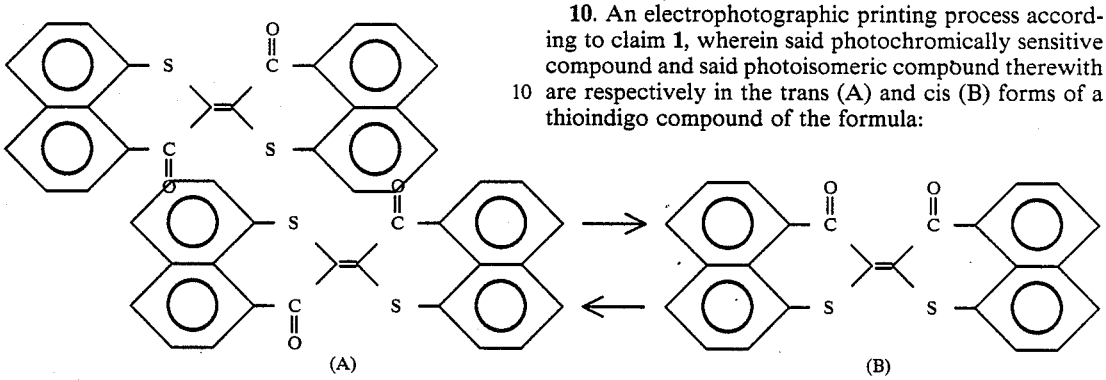

7. The electrophotographic printing process of claim 6, wherein said first wavelength is 620 nm and said second wavelength is 510 nm and said third wavelength is 550 or more.

8. The electrophotographic printing process of claim 4, wherein the surface of the photosensitive means is charged positively.

9. The electrophotographic printing process of claim 4, wherein the surface of the photosensitive means is charged negatively.

10. An electrophotographic printing process according to claim 1, wherein said photochromically sensitive compound and said photoisomeric compound therewith are respectively in the trans (A) and cis (B) forms of a thioindigo compound of the formula:

11. An electrophotographic printing process according to claim 10, wherein said photosensitive means is imagewise exposed with light of a first wavelength of 620 nm and uniformly exposed with a fourth wavelength of 508 nm.

12. An electrophotographic printing process according to claim 10, wherein said second wavelength is 510 nm.

13. An electrophotographic printing process according to claim 10, wherein the entire surface of said photosensitive layer is negatively charged.

* * * * *